US011988494B2

(12) United States Patent
Zhang et al.

(10) Patent No.: US 11,988,494 B2
(45) Date of Patent: May 21, 2024

(54) PISTON-TYPE EXPLOSIVE LOADING AND BLASTING STRUCTURE AND METHOD FOR HARD ROCK CABLE PIT

(71) Applicant: CHINA RAILWAY 18 BUREAU GROUP CO. LTD., Tianjin (CN)

(72) Inventors: Xin Zhang, Tianjin (CN); Jinshan Sun, Tianjin (CN); Xiangping Zhang, Tianjin (CN)

(73) Assignee: CHINA RAILWAY 18 BUREAU GROUP CO. LTD., Tianjian (CN)

( * ) Notice: Subject to any disclaimer, the term of this patent is extended or adjusted under 35 U.S.C. 154(b) by 134 days.

(21) Appl. No.: 17/954,766

(22) Filed: Sep. 28, 2022

(65) Prior Publication Data

US 2024/0068790 A1 Feb. 29, 2024

(30) Foreign Application Priority Data

Aug. 31, 2022 (CN) ..... 202211055419.8

(51) Int. Cl.
*F42D 1/08* (2006.01)
*F42D 3/04* (2006.01)

(52) U.S. Cl.
CPC ..... *F42D 1/08* (2013.01); *F42D 3/04* (2013.01)

(58) Field of Classification Search
CPC ..... F42D 1/08; F42D 1/18; F42D 1/22; F42D 3/04
See application file for complete search history.

(56) References Cited

U.S. PATENT DOCUMENTS 8,011 A * 4/1851 Monson ..... F42D 1/18 217/21
1,772,994 A * 8/1930 Halverson ..... F42D 1/08 102/333
2,129,439 A * 9/1938 Noble ..... F42D 1/18 411/33

* cited by examiner

*Primary Examiner* — Jonathan C Weber
(74) *Attorney, Agent, or Firm* — SZDC Law PC

(57) ABSTRACT

Provided is a piston-type explosive loading and blasting structure for a hard rock cable pit. The structure includes a first-step cut provided at a center of an excavation section and second-step cuts provided on a periphery of the first-step cut; and piston-type explosive loading structures are used for explosives in the first-step cut and the second-step cuts. According to the piston-type explosive loading structures in the present disclosure, due to plastic plugging of stemming and fixed elastic plugging of two disc steel plates, time of energy such as stress waves and explosive gas generated after the explosives explode acting on surrounding rocks is obviously prolonged, rock mass is fully broken, and loose blasting is formed without throwing.

10 Claims, 3 Drawing Sheets

PISTON-TYPE EXPLOSIVE LOADING AND BLASTING STRUCTURE AND METHOD FOR HARD ROCK CABLE PIT

This application claims priority to Chinese Patent Application No. 202211055419.8, filed on Aug. 31, 2022, which is incorporated by reference for all purposes as if fully set forth herein.

TECHNICAL FIELD

The present disclosure relates to the technical field of tunnel construction blasting, in particular to a piston-type explosive loading and blasting structure and method for a hard rock cable pit and application of the piston-type explosive loading and blasting structure for a hard rock cable pit.

BACKGROUND

Since a hard rock cable pit always has a large section and great depth, a mechanical excavation method is used during conventional construction. However, in case of a hard rock stratum, the mechanical excavation method is slow in speed and high in cost. Moreover, if a blasting method is used, flying rocks are required to be absolutely controlled to guarantee safety. An existing construction blasting method is a loose blasting method in most cases, through which blasthole construction is uniformly carried out on a working surface. In order to evenly loosen rocks in a pit, the quantity of explosives loaded into each blasthole is roughly the same, and stemming is directly used to plug the blastholes after the explosives are loaded. With regard to a blasting effect of the loose blasting method, "barrel pulling" often occurs, zero footage is obtained, and coverings are likely to burst up with a loud sound and plenty of flying rocks during blasting, causing huge potential safety hazards. In case of a special rock stratum, for example, a rock hardness of a lower stratum is greater than that of an upper stratum within a depth of a blasthole, "barrel pulling" often occurs during blasting, a blasthole utilization rate is usually 40% or below, and a residual blasthole length occupies 50%-60%.

SUMMARY

The present disclosure provides a piston-type explosive loading and blasting structure for a hard rock cable pit. The structure includes a first-step cut provided at a center of an excavation section and second-step cuts provided on a periphery of the first-step cut.

Piston-type explosive loading structures are used for explosives in the first-step cut and the second-step cuts. Each piston-type explosive loading structure includes a bottom cover, a middle cover, a top cover and a fixing shaft; the bottom cover is fixedly connected to the fixing shaft; the middle cover and the top cover sleeve the fixing shaft; in the first-step cut, an explosive loading region is formed between the bottom cover and the middle cover; and a stemming sealing region is formed between the middle cover and the top cover.

On the basis of the above solution, the fixing shaft is provided with a first threaded section and a second threaded section. Each piston-type explosive loading structure further includes a first fixing seat and a first fixing nut for fixing the middle cover to the first threaded section, the first fixing seat and the first fixing nut being in threaded connection to the fixing shaft at the first threaded section; and a second fixing seat and a second fixing nut for fixing the top cover to the second threaded section, the second fixing seat and the second fixing nut being in threaded connection to the fixing shaft at the second threaded section.

On the basis of the above solution, the structure further includes several cut spreader holes provided on a periphery of the second-step cuts, several auxiliary holes provided on a periphery of the cut spreader holes and several periphery holes provided on a periphery of the auxiliary holes.

The present disclosure further provides a piston-type explosive loading and blasting method for a hard rock cable pit. Specifically, under the situation that a rock hardness f=8-10, piston-type explosive loading structures are used for explosives in a first-step cut (1) and second-step cuts (2).

Under the situation that the rock hardness f=10-20 or above, piston-type explosive loading structures are used for blastholes on a whole section.

On the basis of the above solution, when the explosives are loaded, a bottom cover fixedly connected to a fixing shaft is inserted into a blasthole at first, and powdery explosives and a detonator are loaded into the blasthole according to requirements of blasting design.

After the explosives and the detonator are loaded, the first fixing seat is installed on a first threaded section of the fixing shaft, a middle cover sleeves the fixing shaft from a top end of the fixing shaft and covers the explosives, and the middle cover is fixed at the first threaded section of the fixing shaft by means of a first fixing nut.

After the first fixing nut is installed, stemming is loaded into the blasthole according to requirements of blasting design, a second fixing seat is installed on a second threaded section of the fixing shaft after the stemming is loaded, a top cover sleeves the fixing shaft from a top end of the fixing shaft and covers the stemming, and the top cover is fixed at the second threaded section of the fixing shaft by means of a second fixing nut.

On the basis of the above solution, during blasting, a blasting sequence is: a first-step cut, second-step cuts, cut spreader holes, auxiliary holes and periphery holes, and a large parallel connection method is used as a connecting method.

In the blasting structure in the present disclosure, the piston-type explosive loading structure is used for the cuts, due to plastic plugging of stemming and fixed elastic plugging of two disc steel plates, time of energy such as stress waves and explosive gas generated after the explosives explode acting on surrounding rocks is obviously prolonged, rock mass is fully broken, and loose blasting is formed without throwing. After explosion of the cut spreader holes and the auxiliary holes, energy is also gathered at bottoms of the blastholes, and the rock mass is fully broken due to plugging of all the stemming. A flatten smooth blasting layer is cut after blasting of the periphery holes, and a blasthole-mark rate reaches 100%. It should be especially noted that for blastholes on a whole section under the conditions that rocks at an upper portion are hard and rocks at a lower portion are harder, since energy generated through blasting at bottoms of the blastholes is gathered and action is prolonged, hard rocks are loosened and broken, and an excellent blasting effect is achieved.

DETAILED DESCRIPTION OF THE EMBODIMENTS

The present disclosure will be described in further detail in combination with the accompanying drawings and embodiments. It should be noted that the embodiments described below are intended to facilitate the understanding of the present disclosure, and are not intended to limit it.

Embodiment 1

Figure 1:
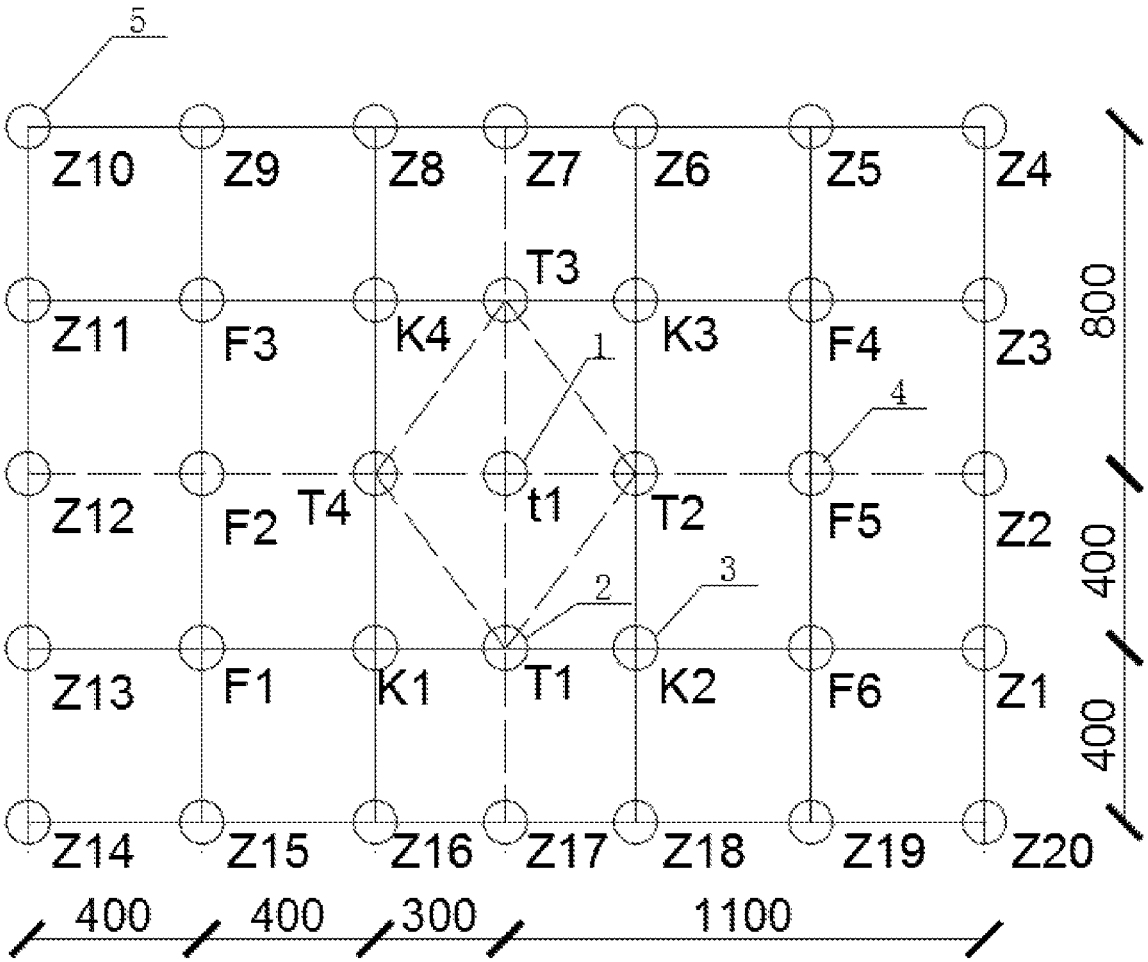
FIG. 1 is a schematic diagram of arrangement of blastholes on an excavation section in a blasting structure in the present disclosure.

As shown in FIG. 1, a piston-type explosive loading and blasting structure for a hard rock cable pit provided in the embodiment includes a first-step cut 1 positioned at a center of an excavation section and second-step cuts 2 provided on a periphery of the first-step cut 1. There are one first-step cut 1 and four second-step cuts 2, and an arrangement structure is a rhombic straight-hole cut structure with a center hole, that is, the four second-step cuts 2 are provided in a rhombus shape, and the first-step cut 1 is positioned at a center of the rhombus shape. The objective of this arrangement is that blasting of the first-step cut 1 is mainly used to loosen and break rocks at the center of the rhombus shape so as to create favorable conditions for blasting of the second-step cuts in the rhombus shape. A cut blasting effect is the most important during blasting construction of a whole excavation section, and therefore the cut blasting problem during blasting construction for hard rocks is to be solved at first in the present disclosure.

Figure 2:
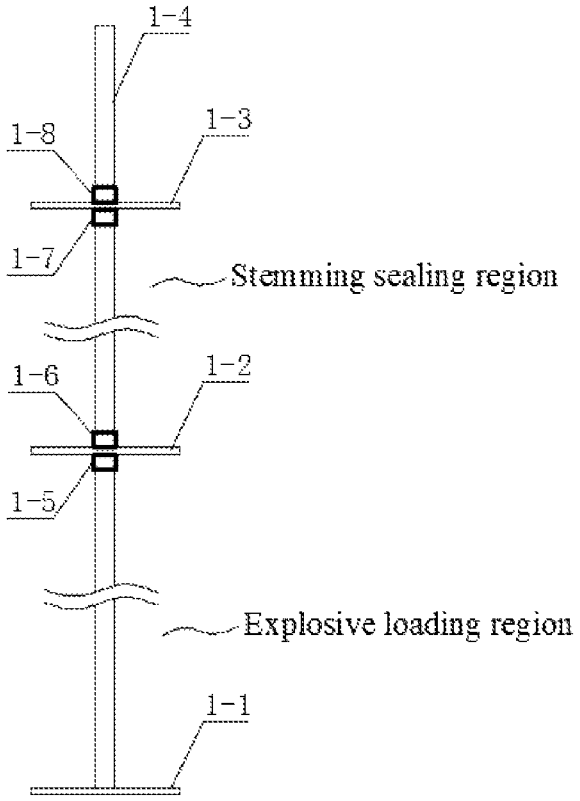
FIG. 2 is a schematic diagram of a piston-type explosive loading structure in the present disclosure.
Figure 3:
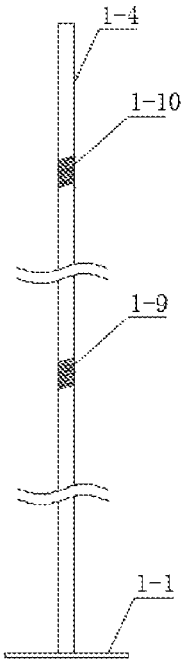
FIG. 3 is a schematic structural diagram of a bottom cover and a fixing shaft in a piston-type explosive loading structure in the present disclosure.
Figure 4:
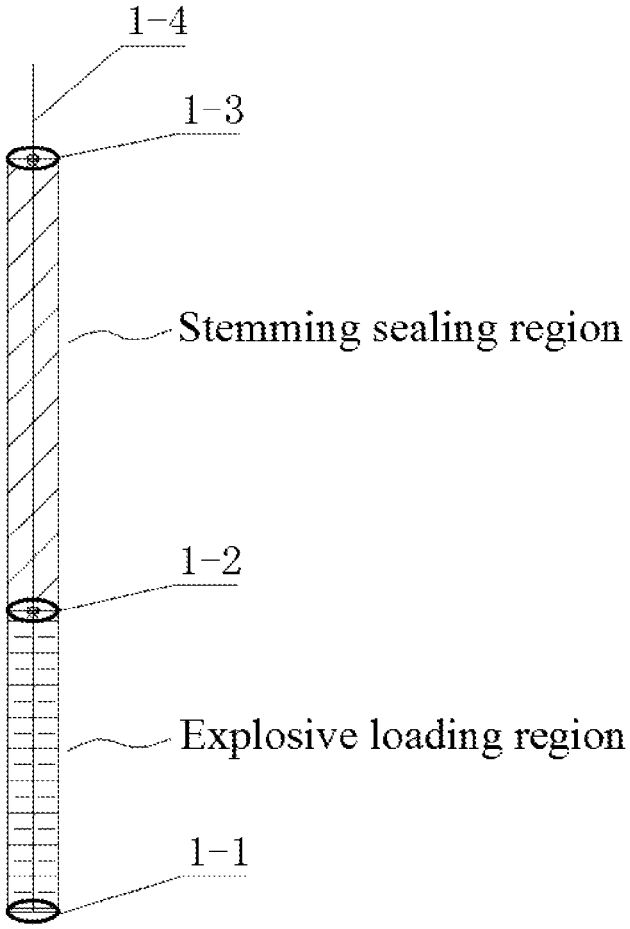
FIG. 4 is a schematic diagram of a use state of a piston-type explosive loading structure in the present disclosure.

Piston-type explosive loading structures are used for explosives in the first-step cut 1 and the second-step cuts 2. As shown in FIGS. 2-4, each piston-type explosive loading structure includes a bottom cover 1-1, a middle cover 1-2, a top cover 1-3 and a fixing shaft 1-4; the bottom cover 1-1 is fixedly connected to the fixing shaft 1-4; the middle cover 1-2 and the top cover 1-3 both sleeve the fixing shaft 1-4; in the first-step cut 1, an explosive loading region is formed between the bottom cover 1-1 and the middle cover 1-2; and a stemming sealing region is formed between the middle cover 1-2 and the top cover 1-3. Specifically, each of the bottom cover 1-1, the middle cover 1-2 and the top cover 1-3 may be a round steel plate and has a diameter 5 mm less than that of a blasthole. Each steel plate may have a thickness of 6 mm. The fixing shaft 1-4 may be made of round steel and may have a diameter of 18 mm. The bottom cover 1-1 may be directly welded to the fixing shaft 1-4.

In order to fix the middle cover 1-2 and the top cover 1-3 more firmly to the fixing shaft 1-4, the patent provides a more optimized implementation case. Specifically, the fixing shaft 1-4 is provided with a first threaded section 1-9 and a second threaded section 1-10. Each piston-type explosive loading structure further includes a first fixing seat 1-5 and a first fixing nut 1-6 for fixing the middle cover 1-2 to the first threaded section 1-9, the first fixing seat 1-5 and the first fixing nut 1-6 being in threaded connection to the fixing shaft 1-4 at the first threaded section 1-9 (the first fixing seat 1-5 may also be welded to the fixing shaft 1-4); and a second fixing seat 1-7 and a second fixing nut 1-8 for fixing the top cover 1-3 to the second threaded section 1-10, the second fixing seat 1-7 and the second fixing nut 1-8 being in threaded connection to the fixing shaft 1-4 at the second threaded section 1-10.

During use, the bottom cover 1-1 fixedly connected to the fixing shaft 1-4 is inserted into a first-step cut 1 at first, and powdery explosives and a detonator are loaded into the first-step cut 1 according to requirements of blasting design. After the explosives and the detonator are loaded, the first fixing seat 1-5 is installed on the first threaded section 1-9 of the fixing shaft 1-4, the middle cover 1-2 sleeves the fixing shaft 1-4 from a top end of the fixing shaft 1-4 and covers the explosives, and the middle cover 1-2 is fixed at the first threaded section 1-9 of the fixing shaft 1-4 by means of the first fixing nut 1-6. After the first fixing nut 1-6 is installed, stemming is loaded into the first-step cut 1 according to requirement of blasting design, the second fixing seat 1-7 is installed on the second threaded section 1-10 of the fixing shaft 1-4 after the stemming is loaded, the top cover 1-3 sleeves the fixing shaft 1-4 from a top end of the fixing shaft 1-4 and covers the stemming, and the top cover 1-3 is fixed at the second threaded section 1-10 of the fixing shaft 1-4 by means of the second fixing nut 1-8.

According to the above cut blasting method in the patent, due to plastic plugging of the stemming and fixed elastic plugging of the middle cover 1-2 and the top cover 1-3, time of energy such as stress waves and explosive gas generated after the explosives explode acting on surrounding rocks is obviously prolonged, rock mass is fully broken, and loose blasting is formed without throwing.

As shown in FIG. 1, besides the first-step cut 1 and the second-step cuts 2 provided on a periphery of the first-step cut 1, the blasting structure in the present disclosure further includes several cut spreader holes 3 provided on a periphery of the second-step cuts 2, several auxiliary holes 4 provided on a periphery of the cut spreader holes 3 and several periphery holes 5 provided on a periphery of the auxiliary holes.

The first-step cut 1, the second-step cuts 2, the cut spreader holes 3, the auxiliary holes 4 and the periphery holes 5 are all perpendicular to the excavation section. Each blasthole has a diameter of 55 mm, powdery coupled bulk explosives are used, and an explosive loading density is 0.8 $g/cm^3$.

The above blasting structure is used for blasting construction of a hard rock cable pit having a rock hardness f=8-10. Under the situation that the rock hardness f=10-20 or above, piston-type explosive loading structures are used for blastholes (which refer to all the cuts, the cut spreader holes, the auxiliary holes and the periphery holes) on a whole section.

As a preferred solution, each of the first-step cut 1 and the second-step cuts 2 has a depth of 1500 mm, and the quantity of loaded explosives is 0.67 kg/hole and 0.68 kg/hole respectively (the total quantity of loaded explosives of the four holes is 2.72 kg). Each of the cut spreader holes 3, the auxiliary holes 4 and the periphery holes 5 has a depth of 1400 mm, there are four cut spreader holes 3 with the total quantity of loaded explosives of 2.27 kg, there are six auxiliary holes 4 with the total quantity of loaded explosives of 3.42 kg, and there are 20 periphery holes 5 with the total quantity of loaded explosives of 7.59 kg.

Embodiment 2

A piston-type explosive loading and blasting method for a hard rock cable pit is provided below, and specific steps are as follows:

S1: Carry Out Blasthole Construction

Carry out blasthole construction on an excavation section by means of a down-the-hole drill, where a first-step cut 1 is positioned at a center of the excavation section, and second-step cuts 2 are provided on a periphery of the first-step cut 1; several cut spreader holes 3 are provided on a periphery of the second-step cuts 2, several auxiliary holes 4 are provided on a periphery of the cut spreader holes 3, and several periphery holes 5 are provided on a periphery of the auxiliary holes 4; and specifically references are made to FIG. 1 and Tables 1 and 2; and clear residual debris and water from each blasthole after drilling is completed.

S2: Load Explosives

When the explosives are loaded, insert a bottom cover 1-1 fixedly connected to a fixing shaft 1-4 into the blasthole at first, and load powdery explosives and a detonator into the blasthole according to requirements of blasting design;

after the explosives and the detonator are loaded, install the first fixing seat 1-5 on a first threaded section 1-9 of the fixing shaft 1-4, enable a middle cover 1-2 to sleeve the fixing shaft 1-4 from a top end of the fixing shaft 1-4 and cover the explosives, and fix the middle cover 1-2 at the first threaded section 1-9 of the fixing shaft 1-4 by means of a first fixing nut 1-6; and after the first fixing nut 1-6 is installed, load stemming into the blasthole according to requirements of blasting design, install a second fixing seat 1-7 on a second threaded section 1-10 of the fixing shaft 1-4 after the stemming is loaded, enable a top cover 1-3 to sleeve the fixing shaft 1-4 from a top end of the fixing shaft 1-4 and cover the stemming, and fix the top cover 1-3 at the second threaded section 1-10 of the fixing shaft 1-4 by means of a second fixing nut 1-8; and use powdery coupled bulk explosives and install detonators for blastholes for which piston-type explosive loading structures are not used, digital tubes being used as the detonators, and after the explosives are loaded, plug the blastholes by means of stemming.

S3: Carry Out Blasting

A blasting sequence is: the first-step cut 1, the second-step cuts 2, the cut spreader holes 3, the auxiliary holes 4 and the periphery holes 5, and a large parallel connection method is used as a connecting method; after the large parallel connection method is used for connection, in order to guarantee safety, cover a blasting body with a layer of straw, then cover the blasting body by means of an abandoned pier form, and fix the blasting body by means of waste steel foot lines, put a cordon within the scope of 200 m in each intersection, evacuate personnel, apparatuses, etc. to the outside of a safety line and carry out blasting; after blasting, check and determine that there is no danger after 15 min, then carry out next working procedure construction.

Compared with conventional loose blasting, the blasting structure and method in the present disclosure have the effects that each cut has a depth greater than that of other blastholes, the cuts are dense, more explosives are loaded into the cuts when the explosives are loaded, a main objective is to obtain cuts through blasting to increase free surfaces, so as to create conditions for blasting of other blastholes. The piston-type explosive loading structures are used for the cuts in the present disclosure, which are simple and easy to manufacture. Due to plastic plugging of stemming and fixed elastic plugging of two disc steel plates, time of energy such as stress waves and explosive gas generated after the explosives explode acting on surrounding rocks is obviously prolonged, rock mass is fully broken, and loose blasting is formed without throwing. After explosion of the cut spreader holes and the auxiliary holes, energy is also gathered at bottoms of the blastholes, and the rock mass is fully broken due to plugging of all the stemming. A flatten smooth blasting layer is cut after blasting of the periphery holes, and a blasthole-mark rate reaches 100%.

It should be especially noted that for blastholes on a whole section under the conditions that rocks at an upper portion are hard and rocks at a lower portion are harder, since energy generated through blasting at bottoms of the blastholes is gathered and action is prolonged, hard rocks are loosened and broken, and an excellent blasting effect is achieved Application Case There is a cable pit beside an up link of an exit of a double-line tunnel 2 at Weijiapo in Hubei section of Zhengzhou-Wanzhou high-speed railway, this cable pit has an excavation section: length×width×depth=2.2 m×1.6 m×1.2 m, rocks are sandstone rocks, a hardness coefficient is f=8-10, and rock integrity is desirable. There are villagers living next to the cable pit, two village roads are positioned 50 m below the cable pit, and a highway is positioned 100 m away from the cable pit, such that safety may not be guaranteed through a traditional loose blasting method.

Existing Solution (1) One excavator is rented, and a breaking hammer is used jointly.

(2) A surveyor surveys a position of a cable pit according to design requirements, and marks out an excavation boundary.

(3) The breaking hammer is used, each work shift is eight hours, excavation is carried out only by 200 mm, surfaces are uneven, as positions become increasingly low, the breaking hammer is inconvenient to operate, a progress is slower, it is estimated that eight days are required to be spent on excavation, hammer and diesel consumption are high, and cost is overhigh.

The blasting structure and method in Embodiments 1 and 2 of the present disclosure are used for construction, and references are made to FIG. 1 and Tables 1 and 2 for specific blasting blasthole positions, blasting parameters, etc.

TABLE 1

Design of Blasting Parameters for Cable Pit

| Serial number | Name of blasthole | Inclination angle (°) | Quantity of blasthole (piece) | Depth (m) | Quantity of loaded explosive (Kg) | Segment number of detonator | Length of stemming (m) | Blasting sequence | Connecting method |
|---|---|---|---|---|---|---|---|---|---|
| 1 | First-step cut | 90 | 1 | 1.5 | 0.67 | 1 | 1.1 | I | Large parallel connection |

TABLE 1-continued

Design of Blasting Parameters for Cable Pit

| Serial number | Name of blasthole | Inclination angle (°) | Quantity of blasthole (piece) | Depth (m) | Quantity of loaded explosive (Kg) | Segment number of detonator | Length of stemming (m) | Blasting sequence | Connecting method |
|---|---|---|---|---|---|---|---|---|---|
| 2 | Second-step cut | 90 | 4 | 1.5 | 2.72 | 3 | 1.1 | II | |
| 3 | Cut spreader hole | 90 | 4 | 1.4 | 2.27 | 5 | 1.1 | III | |
| 4 | Auxiliary holes | 90 | 6 | 1.4 | 3.42 | 7 | 1.1 | IV | |
| 5 | Periphery hole | 90 | 20 | 1.4 | 7.59 | 9 | 1.2 | V | |
| | Subtotal | | 35 | 49.5 | 16.67 | | 40.5 | | |

TABLE 2

Original Blasting Parameters of Cable Pit and Expected Blasting Effect

| Serial number | Name | Unit | Quantity |
|---|---|---|---|
| 1 | Class of surrounding rock | Class | II |
| 2 | Rock hardness | f | 8-10 |
| 3 | Excavation section | $M^2$ | 3.52 |
| 4 | Section type | Rectangle | |
| 5 | Water gushing | None | |
| 6 | Powdery coupled bulk explosive | Explosive loading density 0.8 g/cm$^3$ | |
| 7 | Detonator | Digital tube | |
| 8 | Down-the-hole drill (with a drill pipe and a drill bit) | piece | 1 |
| 9 | Quantity of blasthole on whole section | piece | 35 |
| 10 | Quantity of detonator on whole section | piece | 35 |
| 11 | Full section (cut) Piston-type structure | piece | 5 |
| 12 | Stemming on whole section | box | 12 |
| 13 | Quantity of loaded explosive on full section | Kg | 16.67 |
| 14 | Length of blasthole on whole section | m | 49.5 |
| 15 | Each blasthole footage | m | 1.3 |
| 16 | Blasthole utilization rate | % | 92.8 |
| 17 | Broken rock of each circle | $M^3$ | 4.58 |
| 18 | Unit explosive consumption | Kg/m$^3$ | 3.64 |

TABLE 2-continued

Original Blasting Parameters of Cable Pit and Expected Blasting Effect

| Serial number | Name | Unit | Quantity |
|---|---|---|---|
| 19 | Unit detonator consumption | piece/m | 26.9 |
| 20 | Smooth blasting blasthole-mark rate | % | 100 |

Through the method in the present disclosure, a construction progress is 5 times-6 times that of an original mechanical excavation method, a construction period is saved, and construction cost is 30% of original construction cost. According to the piston-type explosive loading structures, other blastholes are completely plugged by means of the stemming, loosening and breaking are realized, energy utilization of explosives is improved, flying stones are avoided, and construction safety is guaranteed.

What is described above is merely preferred embodiments of the present disclosure, and is not intended to limit the present disclosure in any form. Although the present disclosure is disclosed as above by means of the preferred embodiments, these embodiments are not for defining the present disclosure. Those skilled in the art can make certain alterations or modifications by using the technical contents disclosed above without departing from the scope of the technical solutions of the present disclosure so as to arrive at equivalent embodiments with equivalent changes. However, any simple amendments, equivalent changes, and modifications made to the above embodiments according to the technical essence of the present disclosure without departing from the contents of the technical solutions of the present disclosure still fall within the scope of the technical solutions of the present disclosure.

What is claimed is:

1. A piston-type explosive loading and blasting structure for a hard rock cable pit, comprising a first-step cut (1) provided at a center of an excavation section and second-step cuts (2) provided on a periphery of the first-step cut (1); wherein piston-type explosive loading structures are used for explosives in the first-step cut (1) and the second-step cuts (2), and each piston-type explosive loading structure comprises a bottom cover (1-1), a middle cover (1-2), a top cover (1-3) and a fixing shaft (1-4); the bottom cover (1-1) is fixedly connected to the fixing shaft (1-4); the middle cover (1-2) and the top cover (1-3) sleeve the fixing shaft (1-4); in the first-step cut (1), an explosive loading region is formed between the bottom cover (1-1) and the middle cover (1-2); and a stemming sealing region is formed between the middle cover (1-2) and the top cover (1-3).

2. The piston-type explosive loading and blasting structure for a hard rock cable pit according to claim 1, wherein the fixing shaft (1-4) is provided with a first threaded section (1-9) and a second threaded section (1-10); and each piston-type explosive loading structure further comprises a first fixing seat (1-5) and a first fixing nut (1-6) for fixing the middle cover (1-2) to the first threaded section (1-9), the first fixing seat (1-5) and the first fixing nut (1-6) being in threaded connection to the fixing shaft (1-4) at the first threaded section (1-9); and a second fixing seat (1-7) and a second fixing nut (1-8) for fixing the top cover (1-3) to the second threaded section (1-10), the second fixing seat (1-7) and the second fixing nut (1-8) being in threaded connection to the fixing shaft (1-4) at the second threaded section (1-10).

3. The piston-type explosive loading and blasting structure for a hard rock cable pit according to claim 1, wherein each of the bottom cover (1-1), the middle cover (1-2) and the top cover (1-3) is a round metal plate having a certain thickness, and has a diameter 3-8 mm less than that of the first-step cut (1).

4. The piston-type explosive loading and blasting structure for a hard rock cable pit according to claim 1, further comprising several cut spreader holes (3) provided on a periphery of the second-step cuts (2), several auxiliary holes (4) provided on a periphery of the cut spreader holes (3) and several periphery holes (5) provided on a periphery of the auxiliary holes (4).

5. The piston-type explosive loading and blasting structure for a hard rock cable pit according to claim 1, wherein powdery coupled bulk explosives are used in all blastholes, and an explosive loading density is 0.8 g/cm$^3$.

6. Application of the piston-type explosive loading and blasting structure for a hard rock cable pit of claim 1, wherein the structure is used for blasting of a cable pit having a rock hardness f≥8;

under the situation that the rock hardness f=8-10, piston-type explosive loading structures are used for explosives in a first-step cut (1) and second-step cuts (2); and under the situation that the rock hardness f=10-20 or above, piston-type explosive loading structures are used for blastholes on a full section.

7. A piston-type explosive loading and blasting method for a hard rock cable pit, wherein the blasting structure of claim 1 is used.

8. The piston-type explosive loading and blasting method for a hard rock cable pit according to claim 7, wherein under the situation that a rock hardness f=8-10, piston-type explosive loading structures are used for explosives in a first-step cut (1) and second-step cuts (2); and under the situation that the rock hardness f=10-20 or above, piston-type explosive loading structures are used for blastholes on a full section.

9. The piston-type explosive loading and blasting method for a hard rock cable pit according to claim 7, wherein when explosives are loaded, a bottom cover (1-1) fixedly connected to a fixing shaft (1-4) is inserted into a blasthole at first, and powdery explosives and a detonator are loaded into the blasthole according to requirements of blasting design;

after the explosives and the detonator are loaded, a first fixing seat (1-5) is installed on a first threaded section (1-9) of the fixing shaft (1-4), a middle cover (1-2) sleeves the fixing shaft (1-4) from a top end of the fixing shaft (1-4) and covers the explosives, and the middle cover (1-2) is fixed at the first threaded section (1-9) of the fixing shaft (1-4) by means of a first fixing nut (1-6); and after the first fixing nut (1-6) is installed, stemming is loaded into the blasthole according to requirements of blasting design, a second fixing seat (1-7) is installed on a second threaded section (1-10) of the fixing shaft (1-4) after the stemming is loaded, a top cover (1-3) sleeves the fixing shaft (1-4) from a top end of the fixing shaft (1-4) and covers the stemming, and the top cover (1-3) is fixed at the second threaded section (1-10) of the fixing shaft (1-4) by means of a second fixing nut (1-8).

10. The piston-type explosive loading and blasting method for a hard rock cable pit according to claim 7, wherein during blasting, a blasting sequence is a first-step cut (1), second-step cuts (2), cut spreader holes (3), auxiliary holes (4) and periphery holes (5), and a large parallel connection method is used as a connection method.

* * * * *